US006723419B2

(12) United States Patent
Rogers

(10) Patent No.: US 6,723,419 B2
(45) Date of Patent: Apr. 20, 2004

(54) FOAM FAUX TRAY CEILING SYSTEM

(76) Inventor: Sandra L. Rogers, 501 N. Washington St., Westmont, IL (US) 60559

( * ) Notice: Subject to any disclaimer, the term of this patent is extended or adjusted under 35 U.S.C. 154(b) by 0 days.

(21) Appl. No.: 10/206,775

(22) Filed: Jul. 29, 2002

(65) Prior Publication Data

US 2003/0194535 A1 Oct. 16, 2003

Related U.S. Application Data

(60) Provisional application No. 60/371,394, filed on Apr. 11, 2002.

(51) Int. Cl.[7] ..... B32B 3/12; E04C 1/00; E04B 2/00

(52) U.S. Cl. ..... 428/158; 428/45; 428/57; 428/187; 428/192; 52/309.4; 52/506.1

(58) Field of Search ..... 52/309.4, 311.1, 52/311.2, 312, 506.6, 506.1, 506.09, 304.4; 428/14, 45, 56, 57, 58, 158, 160, 187, 212, 192

(56) References Cited

U.S. PATENT DOCUMENTS

| | | | | | |
|---|---|---|---|---|---|
| 2,778,658 | A | * | 1/1957 | Kaighin | 281/43 |
| 3,251,164 | A | * | 5/1966 | Wright | 52/309.1 |
| 3,481,092 | A | * | 12/1969 | Constantino | 52/309.1 |
| 5,681,652 | A | * | 10/1997 | Cope | 428/318.8 |
| 5,897,932 | A | * | 4/1999 | McGarth et al. | 428/69 |
| 6,117,514 | A | | 9/2000 | Hermann | |
| 6,197,235 | B1 | | 3/2001 | Miller et al. | |
| RE37,436 | E | | 11/2001 | Santarossa | |

* cited by examiner

*Primary Examiner*—Donald J. Loney
(74) *Attorney, Agent, or Firm*—Richard C. Litman

(57) ABSTRACT

A foam faux tray ceiling system having elongated tiles shaped and sized so as to be joinable to one another and thereby form a faux tray ceiling. Each tile is made of a lightweight polymer foam and has a decorative surface, attachment surface, inner edge, outer edge, and two connection edges. The inner edges are preferably decoratively finished and the outer edges are flat.

11 Claims, 6 Drawing Sheets

FOAM FAUX TRAY CEILING SYSTEM

CROSS-REFERENCE TO RELATED APPLICATION

This application claims the benefit of U.S. Provisional Patent Application Serial No. 60/371,394, filed Apr. 11, 2002.

BACKGROUND OF THE INVENTION

1. Field of the Invention

The present invention relates to building construction and interior design, in particular to a foam faux tray ceiling system for new and existing homes.

2. Description of Related Art

A conventional home ceiling is flat with a standard height of eight feet, although specialty ceilings may be constructed in a variety of shapes and sizes to appeal to a particular buyer. Unfortunately, specialty ceilings, such as gabled or vaulted ceilings, are often much more expensive than a conventional ceiling, and the price is even higher when replacing an existing conventional ceiling with a specialty ceiling. The present invention teaches the use of ceiling forms to create the look of a particular type of specialty ceiling known in the trade as a tray ceiling, without the associated costs or need for construction expertise as is ordinarily required.

The present invention pertains to tray ceilings. A room with a tray ceiling has a vertical or angled edge soffit around its ceiling's perimeter and a flat ceiling above that. Some have described a tray ceiling as resembling a room covered by an upside down tray. Presently, tray ceilings are created by cutting wallboard into shaped pieces and attaching the pieces with nails and plaster around the perimeter of an existing traditional ceiling. Molding pieces would then have to be placed along the internal edges of the wallboard to finish the look. The problem with this system is that cutting, shaping and hanging wallboard is a difficult and time consuming process. The average homeowner often lacks the skill and tools necessary to create a presentable tray ceiling with these traditional methods. Also, many homeowners do not have the strength to lift and handle large pieces of uncut wallboard.

There are a number of patents which disclose a variety of material which may be used as suspended ceiling tiles or as moldings attached to ceilings. None of the following patents disclosed the used of preformed, light weight, foam pieces to create a tray ceiling.

For example, U.S. Pat. No. RE37,436 to Santarossa teaches a method of manufacturing an elongated decorative molding having a decorative surface and a desired cross-sectional profile. The Santarossa patent describes moldings and does not suggest a system of interlocking foam tiles for creating a tray ceiling.

U.S. Pat. No. 6,197,235 to Miller et al. discloses a method of manufacture for textured surface panels and panel products made from gypsum fiberboard. This patent teaches forming shaped panels for ceilings but does not show a system of decorative edges and interconnecting pieces that allow for the easily assembly of a tray ceiling as in the present invention. In addition, elongated strips of gypsum fiberboard would be too heavy for convenient, one-person assembly to a ceiling to form a tray ceiling.

U.S. Pat. No. 6,117,514 to Herrmann discloses a ceiling tile system for providing a light-weight and easy-to-form interlocking plastic ceiling tile system for covering a ceiling.

The tile in this patent are made of a very thin plastic sheeting capable of thermal vacuum forming to define reliefs in the sheeting. As such, the ceiling tiles described by Herrmann are not suitable to form a faux tray ceiling with a decorative interior edge, nor are they constructed of light weight foam.

None of the above inventions and patents, taken either singly or in combination, is seen to describe the instant invention as claimed.

SUMMARY OF THE INVENTION

The present invention is a tray ceiling system comprising a plurality of elongated, prefabricated, polymer foam ceiling tiles. Each tile has a decorative surface, an opposing attachment surface, a inside edge, and outside edge, and two connecting edges. The inside edges face the interior of the ceiling and are smoothly finished into a decorative shape (bevel, cove, etc.), while the outside edge faces the wall and may either be a decorative bevel or be adapted for abutment to a wall. The connecting edges may be orthogonal to the length of the tile to form butt joints, or may be at a forty-five degree angle to the length of the tile to form miter joints. The tiles are elongated, preferably between eight and sixteen feet in length, and range in width preferably between six to eighteen inches. The tiles are made from a lightweight foam material, e.g., polyurethane, polystyrene, etc., so that the tiles may be easily installed on the ceiling.

When in use construction adhesive is applied to the attachment surface and the tiles are positioned around the perimeter of a ceiling. The mitered connection edges are positioned adjacent to one another thereby forming right angles that fit into the corners of the ceiling. The light weight of the tiles allows them to be easily manipulated and attached to the ceiling by one person. The smoothly finished inside and outside edges would eliminate the need for molding or for drywall tape and joint compound required to finish edges of drywall or wallboard ceiling tiles. Narrower tiles may be attached to wider tiles to create a stepped look.

Accordingly, it is a principal object of the invention to provide a lightweight alternative to existing tray ceiling construction systems.

It is another object of the invention to provide a tray ceiling system that does not require more than an average amount of upper body strength to install.

It is a further object of the invention to provide a tray ceiling system that is easy to install by unskilled workers.

Still another object of the invention is to provide a tray ceiling system that can be installed without tools or with a minimum of simple tools.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The foam faux tray ceiling system 10, consists of at least four tiles 12*a*, 12*b*, 12*c*, 12*d* preferably precut into lengths designed to form a rectangular soffit around the perimeter of a ceiling C. The soffit is formed by placing the tiles 12*a*–12*d* around the perimeter of a ceiling with the tiles being connected at several joints 14. The joints 14 are preferably sealed with joint compound and painted to match the tiles. The tiles 12*a*–12*d* are made of a lightweight polymer foam material, such as polyurethane or polystyrene, are preferably glued and/or screwed to the ceiling C.

Each tile 12*a*–12*d* in the system 10 is substantially the same with different tiles varying only by length. The length of the tiles 12*a*–12*d* are preferably between eight and sixteen feet, with widths preferably between six and eighteen inches. The tiles 12*a*–12*d* are preferably about one inch thick, so that when the tiles 12*a*–12*d* are applied to the ceiling C, the recess formed by the tiles 12*a*–12*d* resembles an inverted tray. The aforementioned dimensions produce tiles with a much higher length to width ratio than existing ceiling tiles. It will be understood that the aforegoing dimensions are by way of illustration, and actual dimensions may vary.

Figure 1:
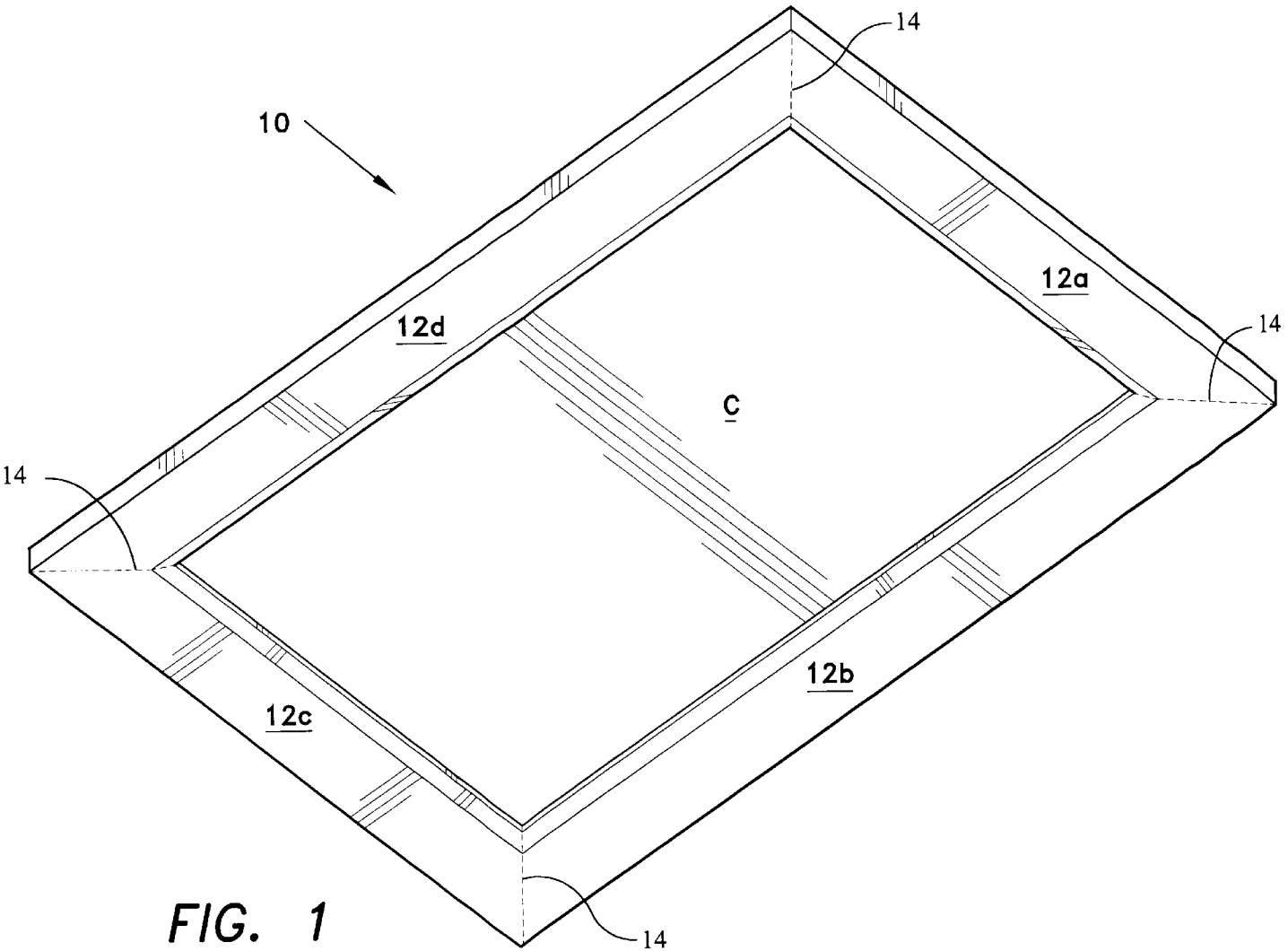
FIG. 1 is an environmental, perspective view of the foam faux tray ceiling system according to the present invention.
Figure 2:
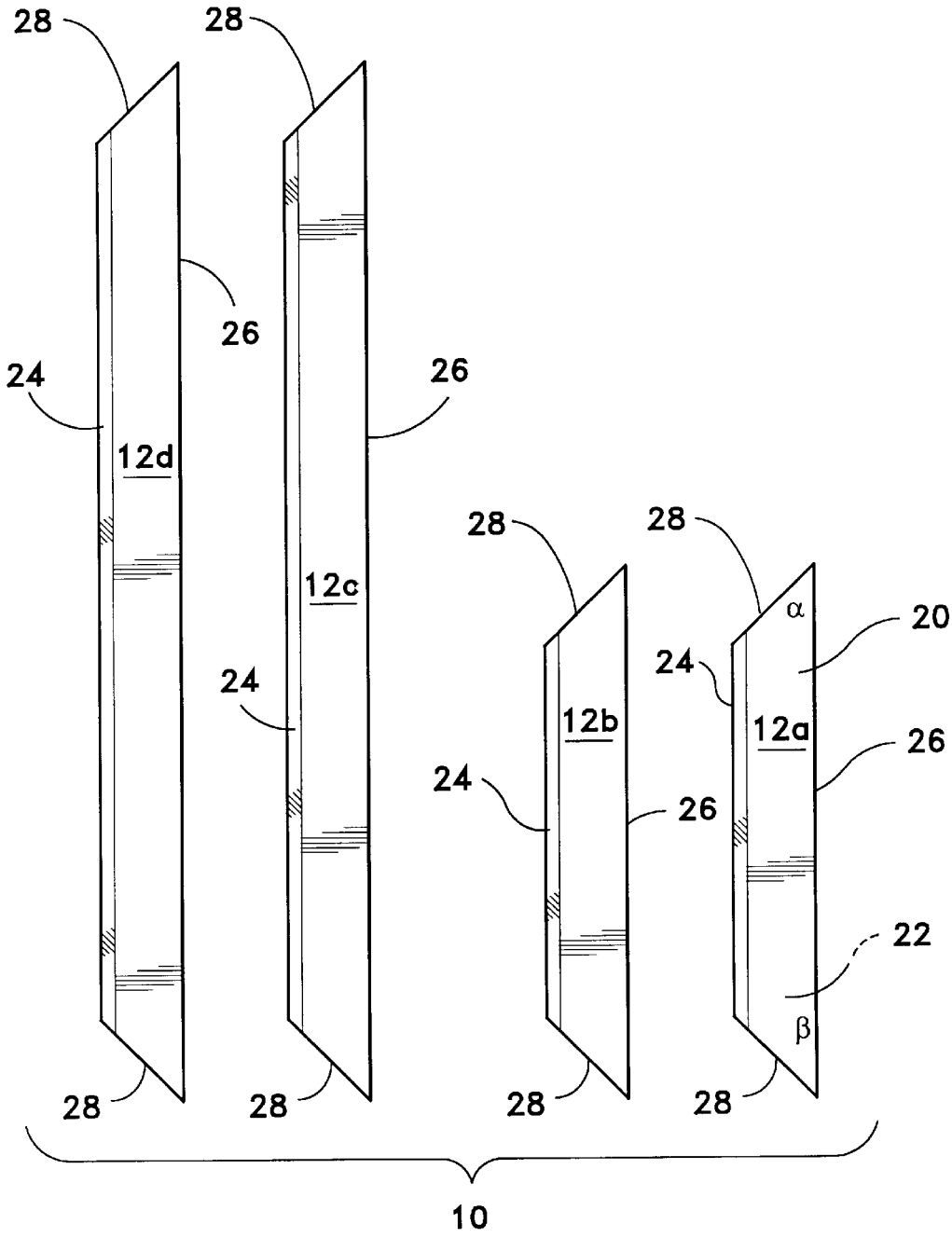
FIG. 2 is an elevation view of the tray ceiling system in its unassembled form.

FIG. 2 shows the system 10 in an unassembled condition. Due to the similarity of the tiles 12*a*–12*d* the following description of tile 12*a* applies generally to all tiles in the system. Tile 12*a* is trapezoidal in shape and has a decorative surface 20, an opposing attachment surface 22 (FIG. 3A), an inner edge 24 which faces towards the interior of the ceiling, an outer edge 26 which abuts the wall, and two opposing connection edges 28 which are joined to adjacent tiles 12*b* and 12*d* in the completed tray ceiling. Angles $\alpha$ and $\beta$, formed by the outer edge 26 and the connecting edges 28, are preferably forty-five degrees. The connection edges 28 are flat and form miter joints when positioned adjacent to the connection edges 28 of other tiles 12*b*–12*d*. One skilled in the art could alter the connection edges 28 so as to form butt joints or interlocking lap joints between adjacent tiles.

Figure 3A:
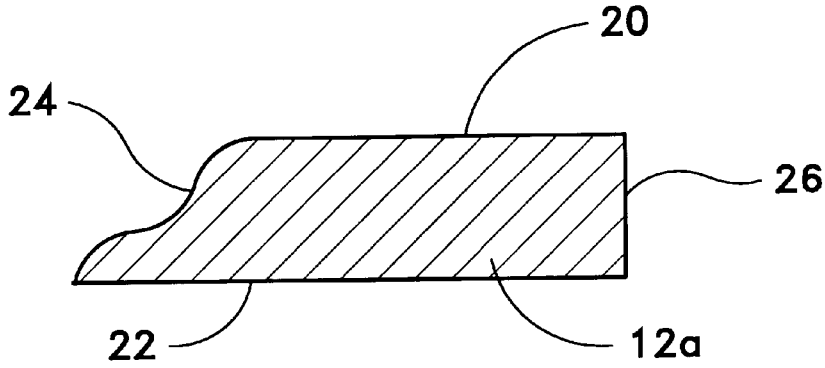
FIG. 3A sectional view of a ceiling tile.

FIG. 3A is a sectional view of tile 12*a*. The tile 12*a* is approximately one inch thick and has a smooth finished decorative inner edge 24. The outer edge 26 is ordinarily flat and defines a ninety degree dihedral angle with the attachment surface 22.

Figure 3B:
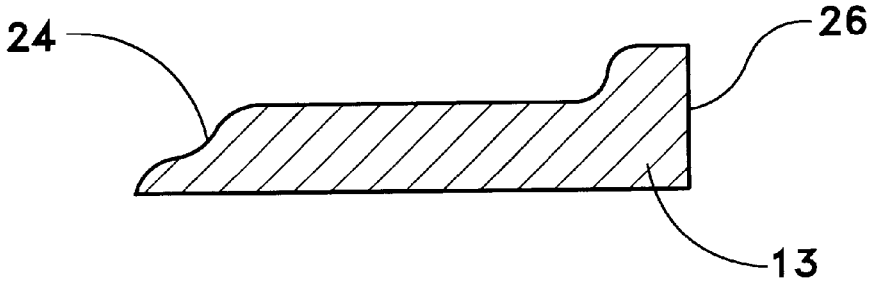
FIG. 3B sectional view of a ceiling tile.
Figure 3C:
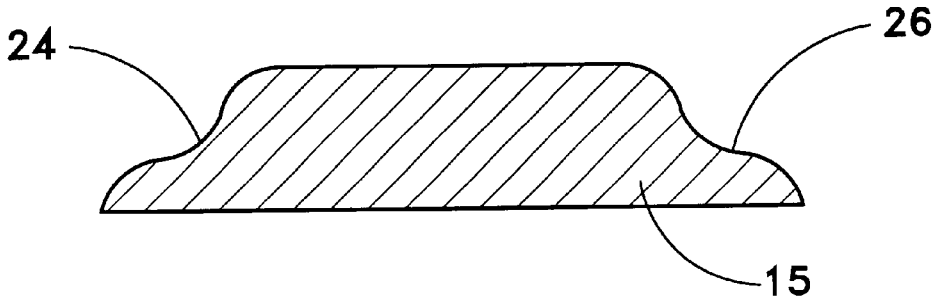
FIG. 3C sectional view of a ceiling tile.

FIGS. 3B and 3C detail sectional views of two tiles 13, 15 with possible variations of the outer 26 and inner 24 edges shown on tile 12*a*, in FIG. 3A. The outer edge 26 of tile 13, shown in FIG. 3B, is cove formed. FIG. 3C details a tile 15 which has symmetrically shaped outer 26 and inner edges 24.

The aforementioned variations are intended to show a sample of the wide variety of edge variations which could be created by one skilled in the art and are not intended to limit the present invention to any particular edge design. In particular, the inner edge 24 of the ceiling tiles may exhibit any of a variety of ornamental or decorative faux designs molded into the inner edge 24 during manufacture of the ceiling tile, e.g., a tooth design with alternate teeth projecting towards the interior of the ceiling, an egg and dart design, etc. The ceiling tiles 12*a*–12*d* are manufactured as pre-formed, integral pieces by casting, molding, foam reservoir molding, elastic reservoir molding, or other plastic forming processes.

Figure 4:
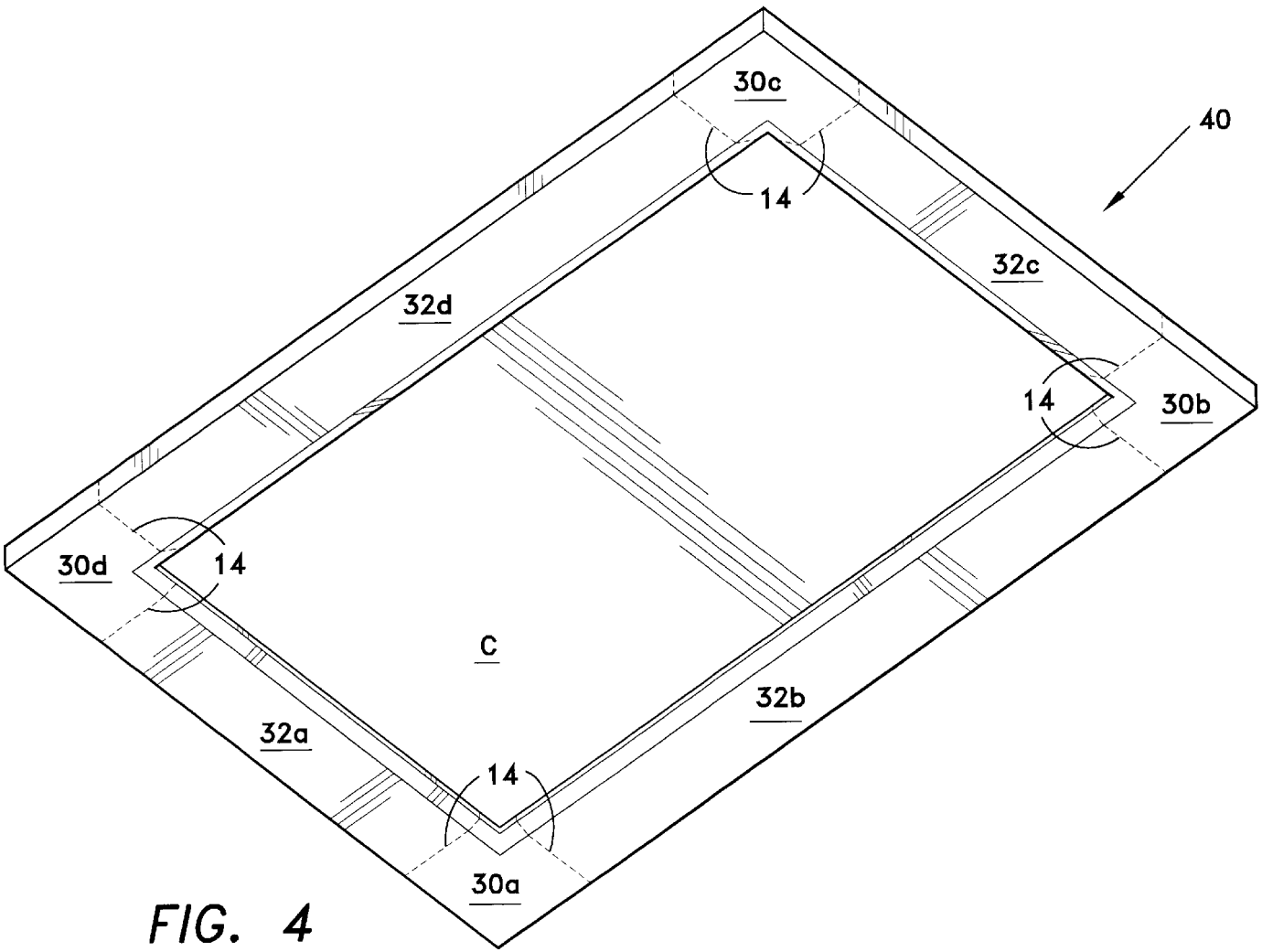
FIG. 4 is an environmental, perspective view of a second embodiment of the foam faux tray ceiling system according to the present invention.

FIG. 4 details an environmental perspective of a second embodiment 40 of the foam faux tray ceiling system. This embodiment has at least eight pieces including, four edge tiles 32*a*, 32*b*, 32*c*, 32*d* and four corner tiles 30*a*, 30*b*, 30*c*, 30*d*. The tiles are positioned to form a soffit around the perimeter of a ceiling and are preferably glued and/or screwed in place. The soffit is created by placing the corner tiles 30*a*–30*d* in the corners of the ceiling C and disposing the edge tiles 32*a*, 32*b*, 32*c*, 32*d* between the corner tiles. The butt joints 14 formed between the tiles are preferably sealed with joint compound and painted.

Figure 5:
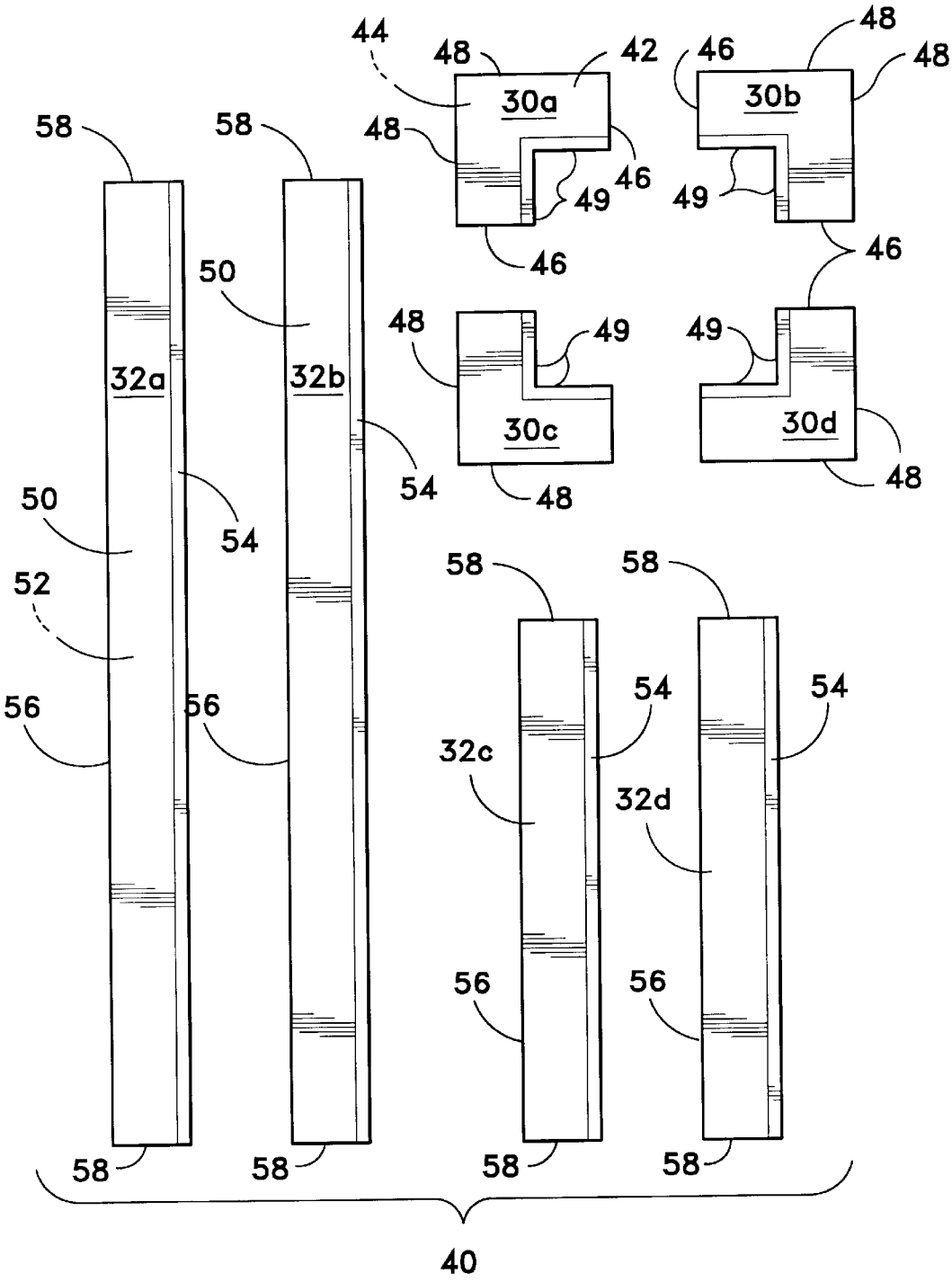
FIG. 5 is an elevation view of the second embodiment of the foam faux tray ceiling system in its unassembled form.

FIG. 5 shows the second embodiment 40 of the foam faux tray ceiling system in its unassembled form. The four corner tiles 30*a*–30*d* are identical, therefore the following description of tile 30*a* applies to all the corner tiles. Corner tile 30*a* has a decorative surface 42, an opposing attachment surface 44, two connection edges 46, two outer edges 48, and two inner edges 49. The two outer edges 48 and the two inner edges 49 may be beveled, coved or flat as described in FIGS. 3A–3C herein above. The connection edges 46, as with the connection edges 28, 30 in the first embodiment, may be altered to form miter joints or interlocking joints with the edges of adjacent tiles.

The edge tiles 32*a*–32*d* differ from each other only by length, so the description of tile 32*a* is applicable to all edge tiles. Edge tile 32*a* is rectangular in shape and has a decorative surface 50, an opposing attachment surface 52, an inner edge 54, an outer edge 56, and two attachment edges 58. The outer edge 56 and inner edge 54 may also be beveled, coved, or flat as described in FIGS. 3A–3C herein above, and the inner edge 54 may have decorative faux designs molded therein during fabrication of the edge tiles 32*a*–32*d*. The tile 32*a* is preferably between eight and sixteen feet long and six to eighteen inches wide. These dimensions create a tile with a higher length to width ration that existing ceiling tiles.

Figure 6A:
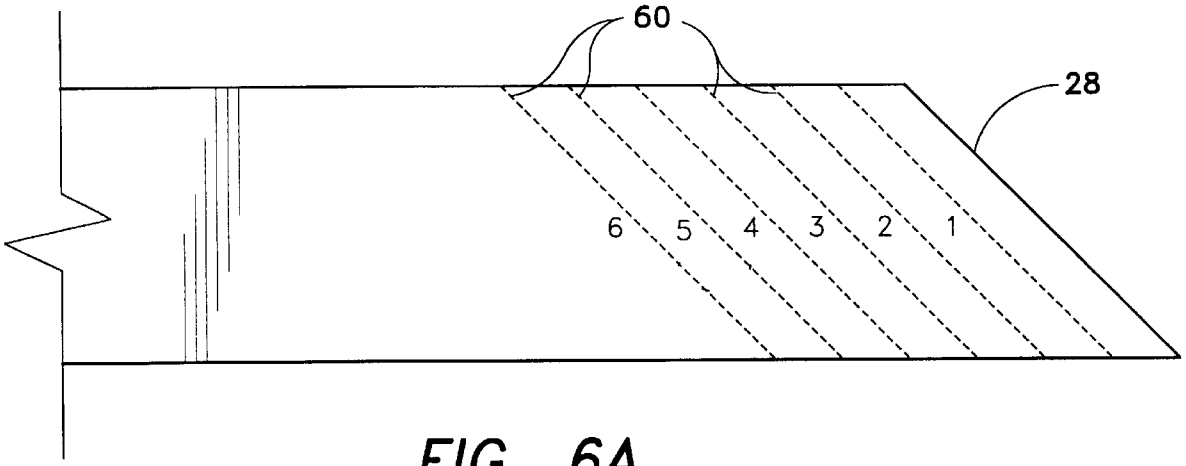
FIG. 6A is an elevation view of the attachment surface of a ceiling tile.
Figure 6B:
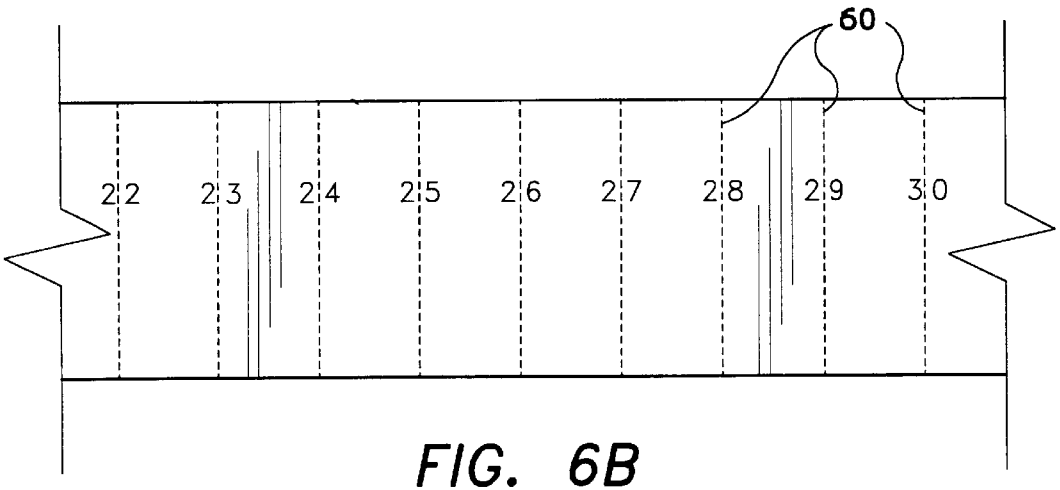
FIG. 6B is an elevation view of the attachment surface of a ceiling tile.

FIGS. 6A and 6B detail optional designs for the attachment surfaces for tiles 12*a*–12*d* and 32*a*–32*d*. FIG. 6A details several score lines 60 running along the attachment surface of the tile 12*a*. The score lines 60 may be marked by indicia to indicate the distance of the score line from the connection edge, and are aligned parallel to one connection edge 28. The score lines 60 serve as reference lines for cutting the tiles for non-standard sized applications. FIG. 6B shows the score lines 60 for tiles 32*a*–32*d* for the second embodiment 40 of the present invention. The score lines run parallel to the connection edges 58 (not shown).

It will be understood that the parts of the two embodiments may be joined into a single kit, and that the ceiling tiles may be made with one end mitered and the other end straight, so that the tray ceiling may have miter joints in the corners and a plurality of ceiling tiles placed end to end by but joints, depending upon the length of a side of the ceiling.

It is to be understood that the present invention is not limited to the sole embodiments described above, but encompasses any and all embodiments within the scope of the following claims.

I claim:

1. A foam faux tray ceiling system, comprising:

a plurality of prefabricated, elongated ceiling tiles sized and dimensioned for forming a rectangular border about a ceiling defining a tray, each of said tiles having a decorative face, an opposing face adapted for attachment to the ceiling, an inner edge, an outer edge and two connecting edges;

wherein said inner edge of each of said ceiling tiles includes a decorative feature selected from the group consisting of a bevel, a groove, a ridge, a curve, a convex edge, a concaved edge, an edge with dart design, an edge with egg design, and an edge with alternating teeth design;

wherein said opposing face extends from said inner edge to said outer edge; and wherein said tiles are made of lightweight polymer foam;

whereby when each of said tiles is attached the ceiling along a surrounding wall, said opposing face and said outer edge of each of said tiles are adjacent to the corner formed by the ceiling and the wall.

2. The foam faux tray ceiling system according to claim 1, wherein each said ceiling tile is trapezoidal in shape, the angle between the outer edge and each connection edge being about 45 degrees, whereby adjoining ceiling tiles form a miter joint at corners of the ceiling.

3. The foam faux tray ceiling system according to claim 1, wherein each of said ceiling tiles has a pair of straight edges for forming butt joints with adjoining ceiling tiles.

4. The foam faux tray ceiling system according to claim 3, further comprising a plurality of L-shaped corner ceiling tiles for attachment to ceiling corners, said elongated ceiling tiles forming butt joints with said corner tiles.

5. The foam faux tray ceiling system according to claim 1, wherein each said ceiling tile has a length between about eight feet and sixteen feet.

6. The foam faux tray ceiling system according to claim 1, wherein each said ceiling tile has a width between about six inches and eighteen inches.

7. The foam faux tray ceiling system according to claim 1, wherein each said ceiling tile has a thickness of about one inch.

8. The foam faux tray ceiling system according to claim 1, wherein each said ceiling tile is made from polyurethane foam.

9. The foam faux tray ceiling system according to claim 1, wherein each said ceiling tile is made from polystyrene foam.

10. The foam faux tray ceiling system according to claim 1, wherein each of said ceiling tiles has a decoratively shaped inner edge facing the interior of the rectangular border and a decoratively shaped outer edge facing the exterior of the rectangular border.

11. The foam faux tray ceiling system according to claim 1, wherein each opposing face of said ceiling tiles is marked with measurement lines.

* * * * *